US008841538B2

(12) United States Patent
Wei

(10) Patent No.: US 8,841,538 B2
(45) Date of Patent: Sep. 23, 2014

(54) DETACHABLE ELECTRONIC DRUM

(75) Inventor: Guo-Hsiung Wei, New Taipei (TW)

(73) Assignee: AI-Musics Technology Inc., New Taipei (TW)

( * ) Notice: Subject to any disclaimer, the term of this patent is extended or adjusted under 35 U.S.C. 154(b) by 117 days.

(21) Appl. No.: 13/541,801

(22) Filed: Jul. 5, 2012

(65) Prior Publication Data

US 2013/0098227 A1 Apr. 25, 2013

(30) Foreign Application Priority Data

Oct. 20, 2011 (CN) ..... 2011 1 0319809

(51) Int. Cl.

| | |
|---|---|
| ***G10H 1/32*** | (2006.01) |
| ***G10H 3/00*** | (2006.01) |
| ***G10D 13/02*** | (2006.01) |
| ***G10H 1/00*** | (2006.01) |
| ***G10H 3/14*** | (2006.01) |

(52) U.S. Cl.

CPC ..... *G10D 13/02* (2013.01); *G10D 13/024* (2013.01); *G10H 1/00* (2013.01); *G10H 1/32* (2013.01); *G10H 3/14* (2013.01)

USPC ..... 84/743; 84/104; 84/107; 84/411 R; 84/723

(58) Field of Classification Search

None

See application file for complete search history.

(56) References Cited

U.S. PATENT DOCUMENTS

| | | | | | |
|---|---|---|---|---|---|
| 4,679,479 | A * | 7/1987 | Koyamato | 84/743 |
| 4,700,602 | A * | 10/1987 | Bozzio | 84/732 |
| 5,056,403 | A * | 10/1991 | Yamashita | 84/723 |
| 5,293,000 | A * | 3/1994 | Adinolfi | 84/730 |
| 5,583,307 | A * | 12/1996 | Tobia, Jr. | 84/411 R |
| 5,585,581 | A * | 12/1996 | Rogers | 84/414 |
| 7,439,432 | B2 * | 10/2008 | Hiraku | 84/414 |
| 7,667,130 | B2 * | 2/2010 | Mishima | 84/723 |
| 7,737,351 | B2 * | 6/2010 | Suzuki | 84/411 R |
| 8,039,724 | B1 * | 10/2011 | Norman et al. | 84/743 |
| 8,431,813 | B2 * | 4/2013 | Mori | 84/723 |
| 8,563,843 | B1 * | 10/2013 | Shemesh | 84/743 |
| 2003/0037660 | A1 * | 2/2003 | Suenaga | 84/411 R |
| 2003/0188624 | A1 * | 10/2003 | Toda | 84/411 P |
| 2004/0200338 | A1 * | 10/2004 | Pangrle | 84/724 |
| 2005/0016367 | A1 * | 1/2005 | Hasenmaier | 84/723 |
| 2005/0022655 | A1 * | 2/2005 | Wise | 84/743 |
| 2005/0211062 | A1 * | 9/2005 | Hiraku | 84/414 |
| 2006/0174756 | A1 * | 8/2006 | Pangrle | 84/724 |
| 2009/0241755 | A1 * | 10/2009 | Yoshino et al. | 84/421 |
| 2013/0098227 | A1 * | 4/2013 | Wei | 84/723 |

* cited by examiner

*Primary Examiner* — Marlon Fletcher

(74) *Attorney, Agent, or Firm* — Han IP Corporation

(57) ABSTRACT

An electronic drum has an induction board and a securing frame. The induction board has a drumhead, a connection device and a detecting assembly. The connection device is adapted to be electrically connected with an outer acoustic device. The detecting assembly is mounted under the drumhead and is electrically connected with the connection device to detect beats on the drumhead and to send acoustic signal to the connection device. The annular securing frame is mounted around the induction board and has an annular bracket, an outer securing rib and a bottom securing rib. The annular bracket has an outer periphery and a bottom. The outer securing rib protrudes outward from the outer periphery of the annular bracket. The bottom securing rib protrudes from the bottom of the annular bracket.

15 Claims, 9 Drawing Sheets

DETACHABLE ELECTRONIC DRUM

BACKGROUND OF THE INVENTION

1. Field of the Invention

The present invention relates to an electronic drum, and more particularly to a detachable electronic drum that can be easily and conveniently attached to and detached from a drum.

2. Description of Related Art

Drums, such as Jazz tom-tom are popular and are widely used in pop, jazz, heavy metal or symphony. With reference to FIG. 9, a conventional drum 80 comprises a hollow body, two holding rims 82 and two drumheads 81. The drumheads 81 are respectively mounted securely on two opening ends of the body with the holding rims 82 to respectively close the opening ends of the body. When one of the drumheads 81 is beaten, acoustic sound will generate with the resonance of the hollow body.

With reference to FIG. 10, an electronic drum comprises a solid induction board 90, a sensor 91 and an elastic drumhead 92. The drumhead 92 is made of an elastic material, such as rubber, and the sensor 91 is mounted beneath the drumhead 92. When the drumhead 92 is beaten, the sensor 91 detects the beats and sends signals to a speaker or an earphone that is electrically connected with the electronic drum to generate acoustic sound from the speaker or the earphone.

However, the acoustic sound generated by the conventional drum is strong and solid but the sound volume cannot be adjusted, so that the conventional drum easily makes noise the other people to play. The acoustic sound generated by the electronic drum can be adjusted but is not strong and solid as that generated by the conventional drum. Therefore, a drummer may play music with the conventional drums and practice with the electronic drums. However, to play or practice music, multiple conventional drums and electronic drums of different kinds are necessary. The user has to attach and detach the conventional drums and the electronic drums onto or from a stand for playing music or practicing, and this is troublesome and time-consuming and inconvenient in use.

In addition, U.S. Pat. No. 8,039,724 disclosed another electronic drum, but the electronic drum of the '724 patent is mounted beneath the drumhead of a drum. Therefore, to attach or detach the electronic drum onto or from the drum is troublesome and time-consuming.

To overcome the shortcomings, the present invention tends to provide an electronic drum to mitigate or obviate the aforementioned problems.

SUMMARY OF THE INVENTION

The main objective of the invention is to provide a detachable electronic drum that can be easily and conveniently attached to and detached from a drum.

The electronic drum has an induction board and a securing frame. The induction board has a drumhead, a connection device and a detecting assembly. The connection device is adapted to be electrically connected with an outer acoustic device. The detecting assembly is mounted under the drumhead and is electrically connected with the connection device to detect beats on the drumhead and to send acoustic signal to the connection device. The annular securing frame is mounted around the induction board and has an annular bracket, an outer securing rib and a bottom securing rib. The annular bracket has an outer periphery and a bottom. The outer securing rib protrudes outward from the outer periphery of the annular bracket. The bottom securing rib protrudes from the bottom of the annular bracket.

Other objects, advantages and novel features of the invention will become more apparent from the following detailed description when taken in conjunction with the accompanying drawings.

DETAILED DESCRIPTION OF PREFERRED EMBODIMENT

Figure 1:
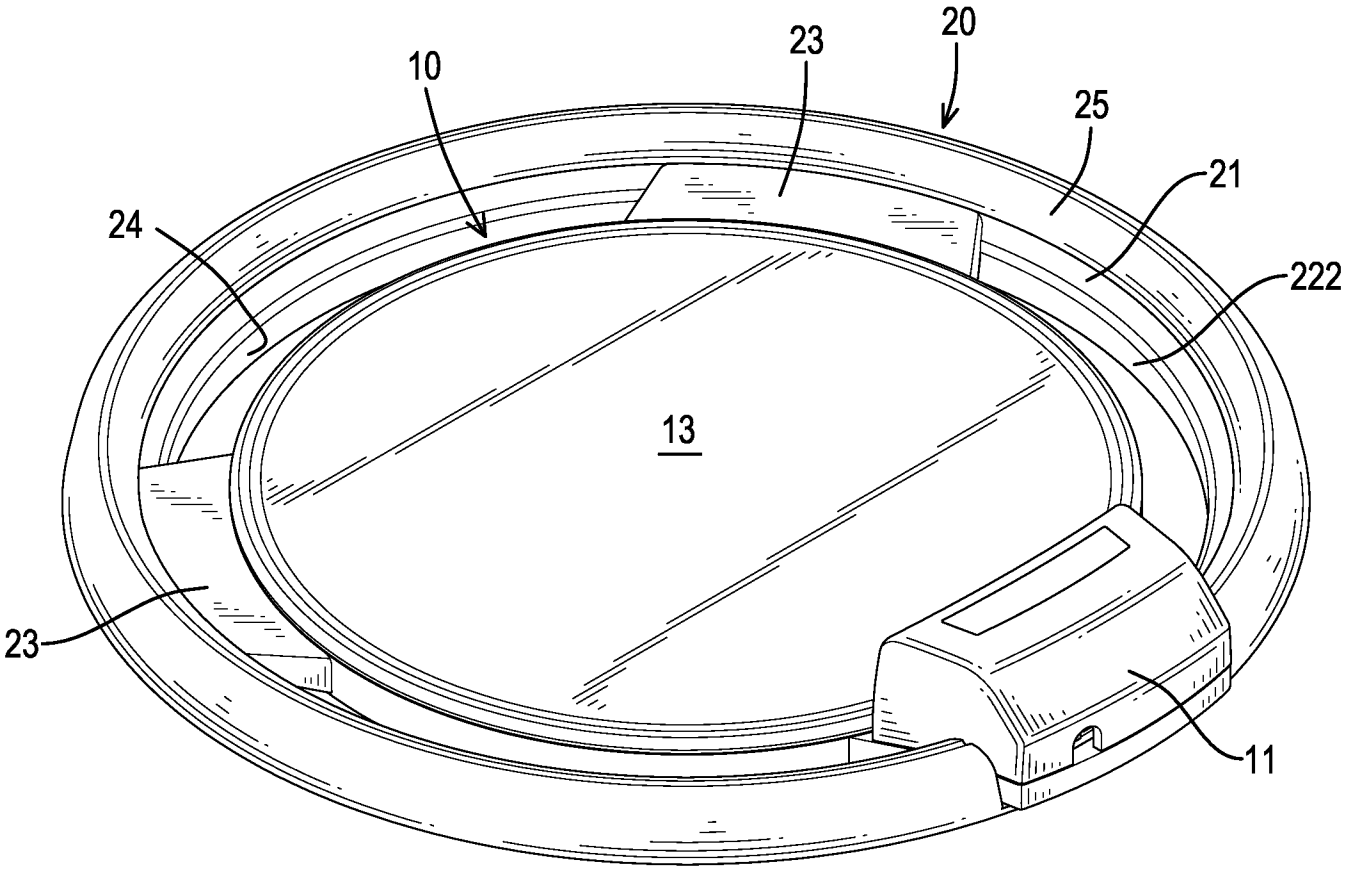
FIG. 1 is a perspective view of a first embodiment of an electronic drum in accordance with the present invention.
Figure 2:
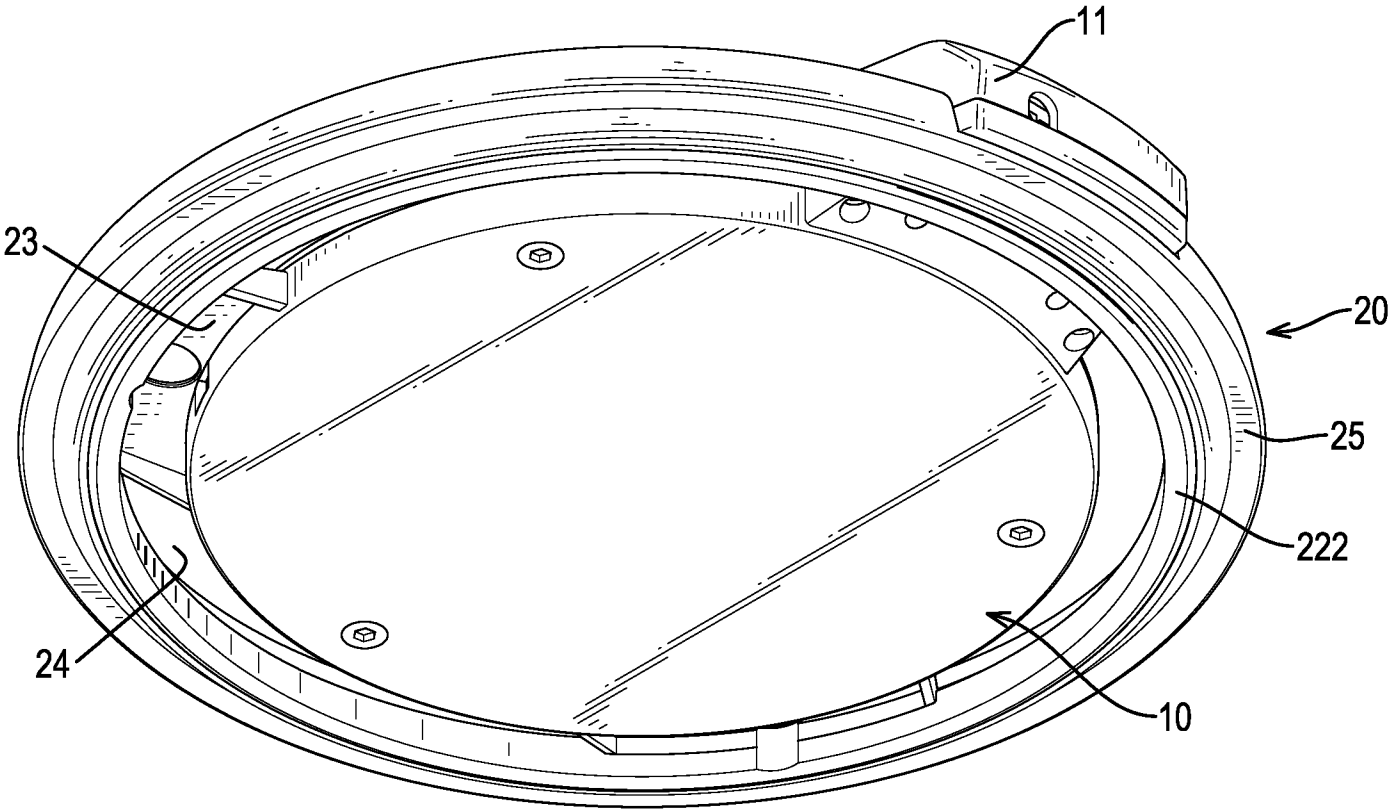
FIG. 2 is a bottom perspective view of the electronic drum in FIG. 1.
Figure 3:
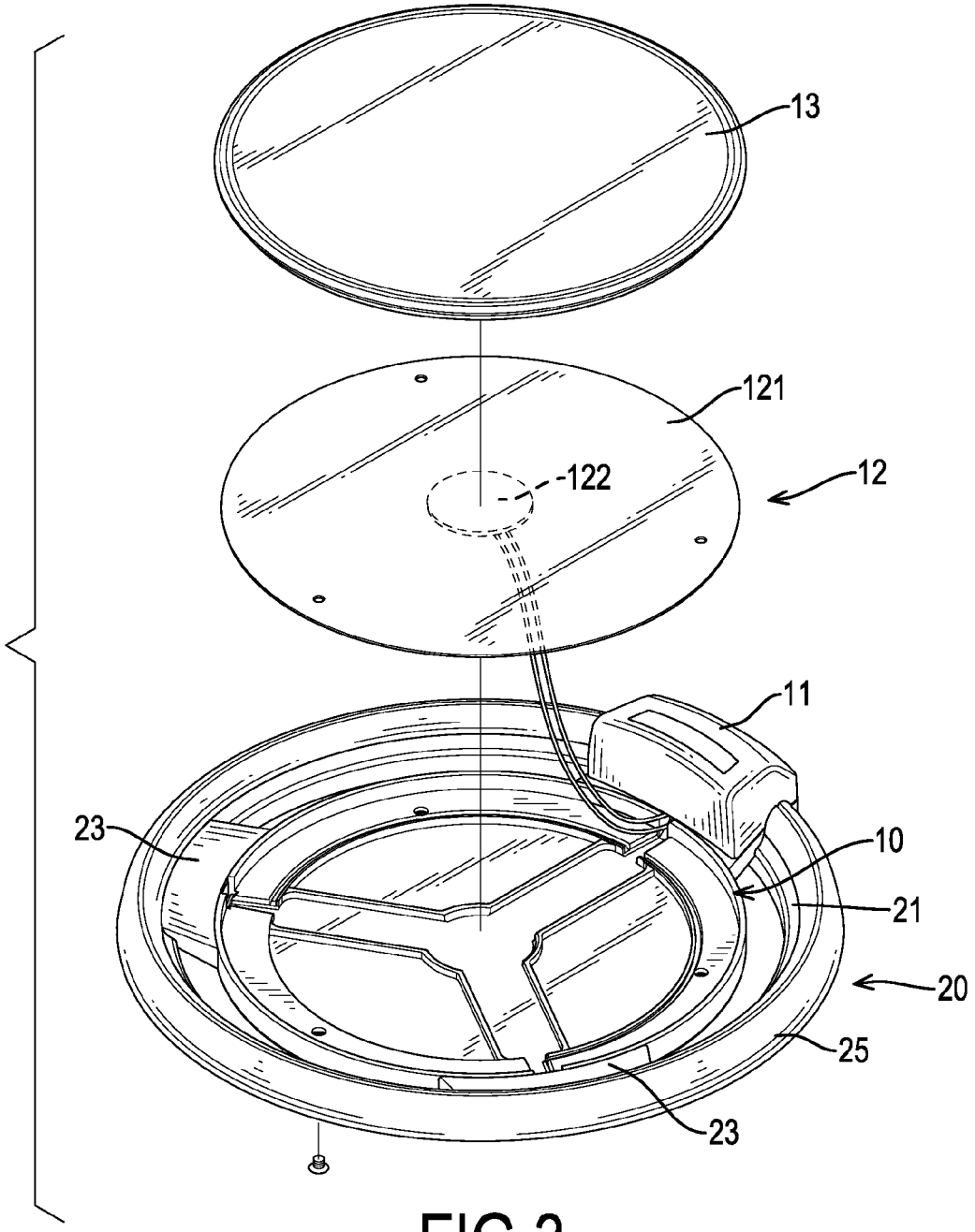
FIG. 3 is an exploded perspective view of the electronic drum in FIG. 1.

With reference to FIGS. 1 to 3, an electronic drum in accordance with the present invention comprises an induction board 10 and a securing frame 20.

The induction board 10 has a connection device 11, a drumhead 13 and a detecting assembly 12. The connection device 11 is adapted to be electrically connected with an outer acoustic device, such as a speaker or an earphone. The drumhead 13 is elastic and may be made of rubber. The detecting assembly 12 is mounted under the drumhead 13 and is electrically connected with the connection device 11 to detect beats on the drumhead 13 and to send acoustic signal to the connection device 11. Preferably, the detecting assembly 12 comprises a metal disk 121 and a sensor chip 122. The metal disk 121 is mounted under the drumhead 13 and has a bottom opposite to the drumhead 13. The sensor chip 122 is mounted on the bottom of the metal disk 121 to detect vibrations of the metal disk 121 and is electrically connected with the connection device 11 to send acoustic signal to the connection device 11.

Figure 6:
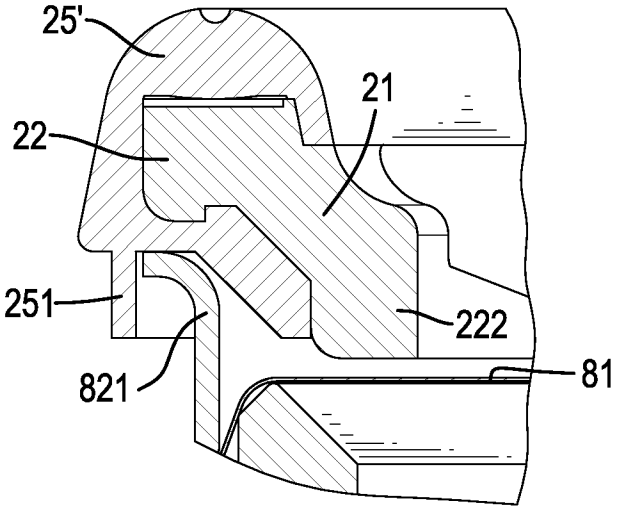
FIG. 6 is an enlarged cross sectional side view of the electronic drum in FIG. 4 attached to a drum.

The securing frame 20 is annular, is mounted around the induction board 10 and comprises an annular bracket 21, an outer securing rib 22 and a bottom securing rib 222. The annular bracket 21 is connected to the induction board 10 and has an outer periphery and a bottom. The outer securing rib 22 may be annular and protrudes outward from the outer periphery of the annular bracket 21, and the bottom securing rib 222 may be annular and protrudes from the bottom of the annular bracket 21. In addition, the securing frame 20 may further have multiple connecting panels 23 separately formed on and protruding from an inner periphery of the annular bracket 21 at intervals and connected to the induction board 10. Alternatively, with reference to FIG. 4, the securing frame 20' may further have an annular connection plate 23' formed on and protruding from an inner periphery of the annular bracket 21' and connected to the induction board 10. The connection plate 23' has multiple ventilation holes 24' formed through the connection plate 23'. In addition, with reference to FIG. 5, the securing frame 20 further has an annular elastic collar 25 mounted around the annular bracket 21 and the outer securing rib 22. With reference to FIG. 6, the annular elastic collar 25' has annular wall 251 formed on and protruding downward from a bottom of the annular elastic collar 25'.

Figure 7A:
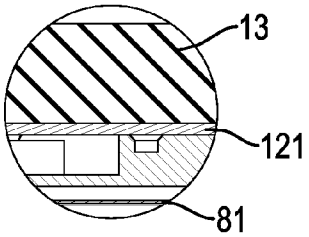
FIG. 7A is an enlarged cross sectional side view of the electronic drum in FIG. 7.
Figure 7:
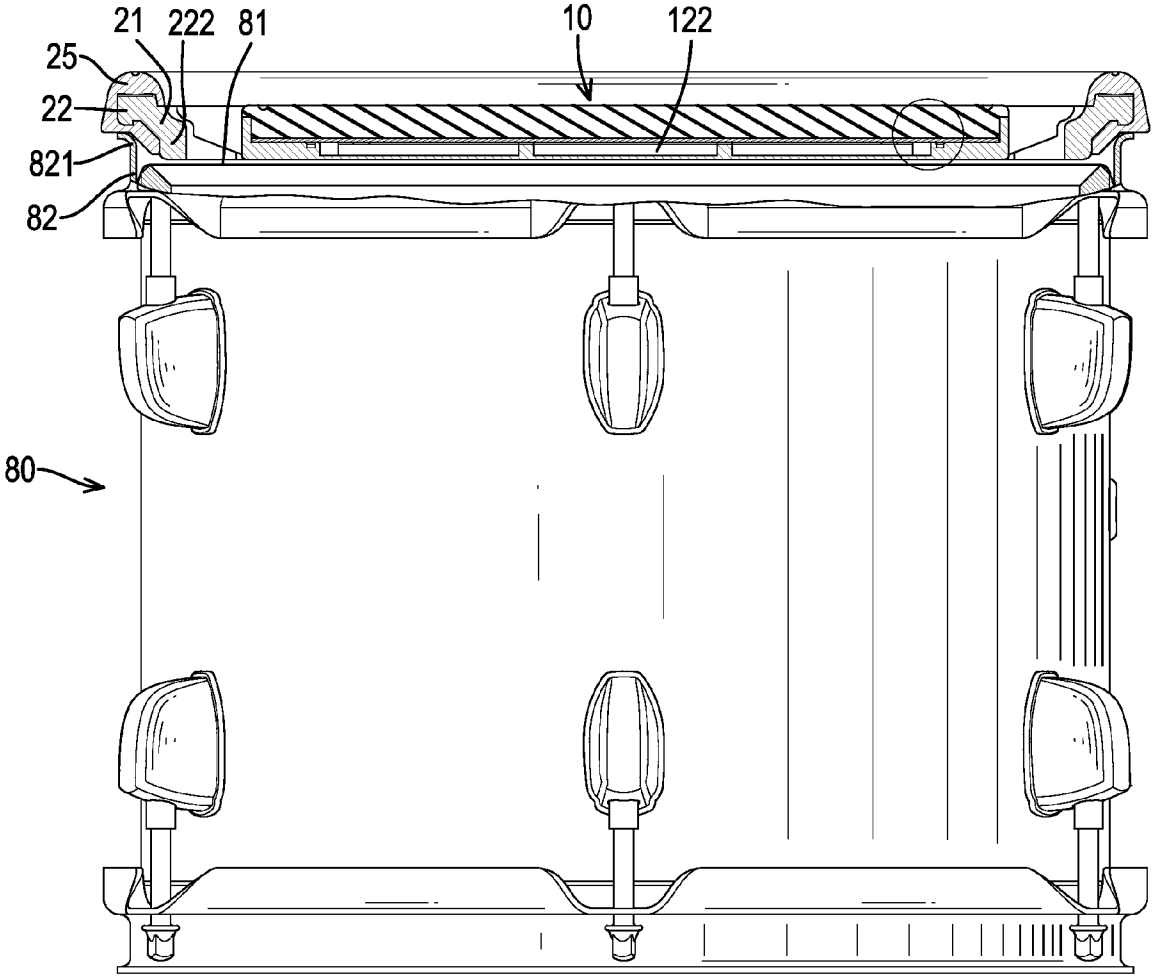
FIG. 7 is a side view in partial section of the electronic drum in FIG. 1 attached to a drum.

With reference to FIGS. 1, 7 and 7A, to attach the electronic drum onto a drum 80, the annular bracket 21 of the securing frame 20 is attached to a holding rim 82 of the drum 80. The outer securing rib 22 and the bottom securing rib 222 respectively abut against the top and the inner periphery of the holding rim 82, such that the induction board 10 can be securely held above the drumhead 81 of the drum 80. When the induction board 10 is beaten, the sensor chip 122 can detect the vibrations of the metal plate 121 and sends acoustic signal to the connection device 11. Then, the connection device 11 can send signal and actuate the outer acoustic device, such a speaker or an earphone to generate acoustic sound. Because the sound volume generated by the outer acoustic device can be adjusted, to noise the other people can be prevented while a user is practicing with the electronic drum in accordance with the present invention. With the arrangement of the bottom securing rib 222 that abuts against the inner periphery of the holding rim 82, the position of the induction board 10 can be kept from being shifted. With the arrangement of the outer securing rib 22, the securing frame 20 can be stably mounted on and fitted with different drums 80 having different holding rims 82 of different sizes.

In addition, because the holding rim 82 of the drum 80 always has a protruding flange 821, the securing frame 20 is mounted on the protruding flange 821 to enable the induction board 10 to space from the drumhead 81 of the drum 80. Therefore, the drumhead 81 of the drum 80 will not be vibrated while the user beats the induction board 10 so as to keep the drum 80 from generating acoustic sound.

Furthermore, with the separating connecting panels 23 as shown in FIG. 3, multiple intervals 24 are formed between the connecting panels 23, such that the space between the induction board 10 and the drumhead 81 of the drum 80 is not enclosed or sealed. Thus, the air in the space between the induction board 10 and the drumhead 81 of the drum 80 will not be compressed while the induction board 10 is beaten, such that the drum 80 can be effectively prevented from generating acoustic sound.

Figure 4:
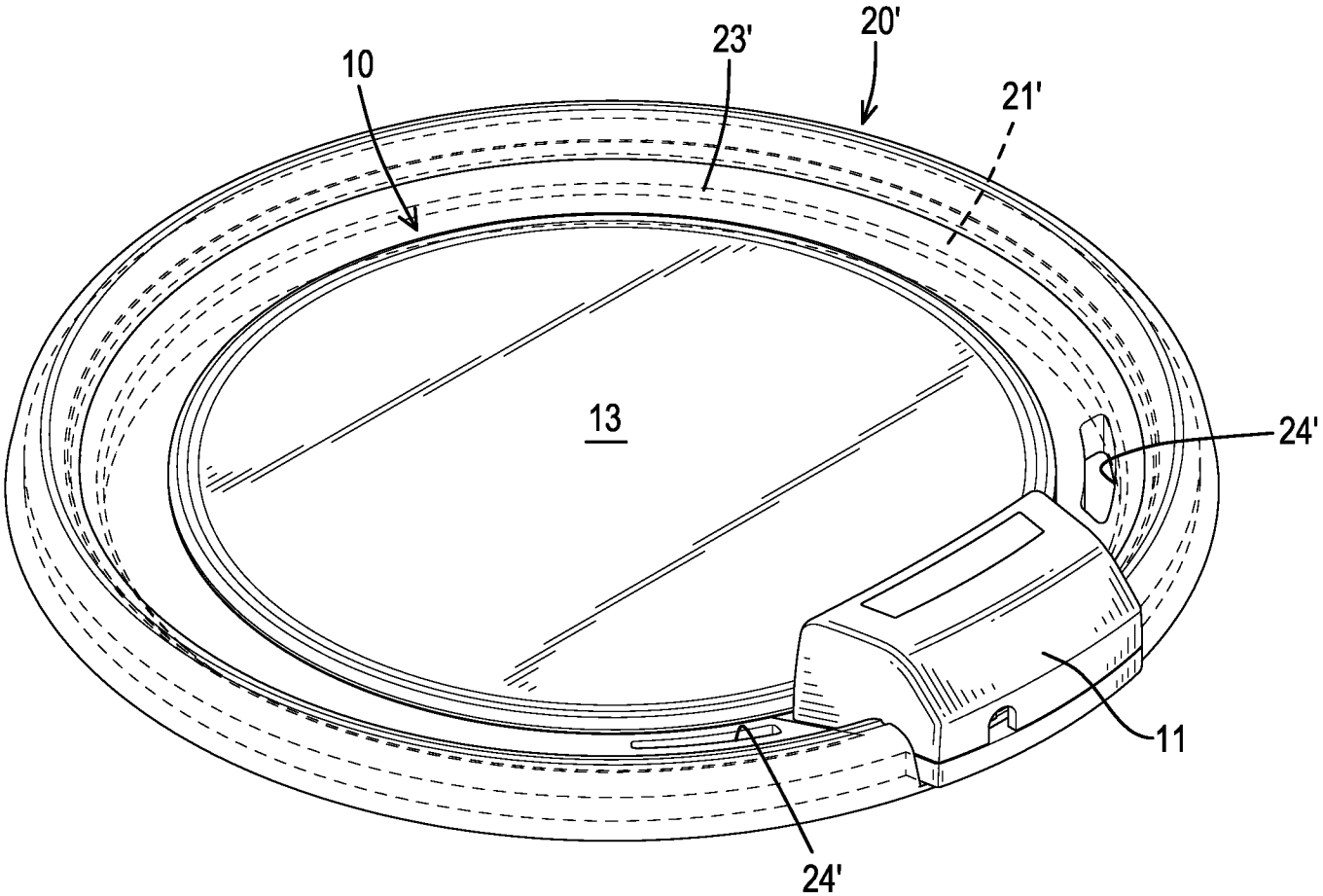
FIG. 4 is a perspective view of a second embodiment of an electronic drum in accordance with the present invention.
Figure 5:
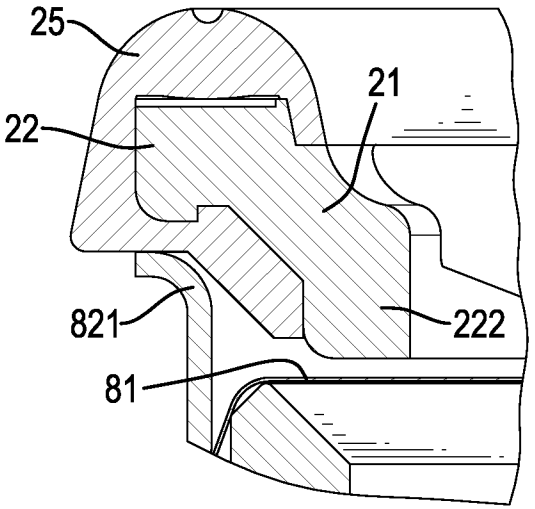
FIG. 5 is an enlarged cross sectional side view of the electronic drum in FIG. 1 attached to a drum.

The annular connection plate 23' as shown in FIG. 4 can increase the connection area between the annular bracket 21' and the induction board 10, such that the connection strength between the annular bracket 21' and the induction board 10 can be effectively improved. The ventilation holes 24' in the connection plate 23' can also prevent the air in the space between the induction board 10 and the drumhead 81 of the drum 80 from being compressed and vibrated, such that the drum 80 can be effectively prevented from generating acoustic sound.

The annular wall 251 on the annular elastic collar 25' is mounted around the protruding flange 821 of the holding rim 82 on the drum 80 to hold the protruding flange 821 between the bottom securing rib 22 and the annular wall 251, such that the shift of the electronic drum in accordance with the present invention can be effectively prevented.

Accordingly, the electronic drum can be easily and conveniently attached to or detached from a drum 80, so to attach and detach multiple drums and electronic drums onto or from a stand for playing music or to practicing is unnecessary and to use the electronic drums in accordance with the present invention is convenient.

Figure 8:
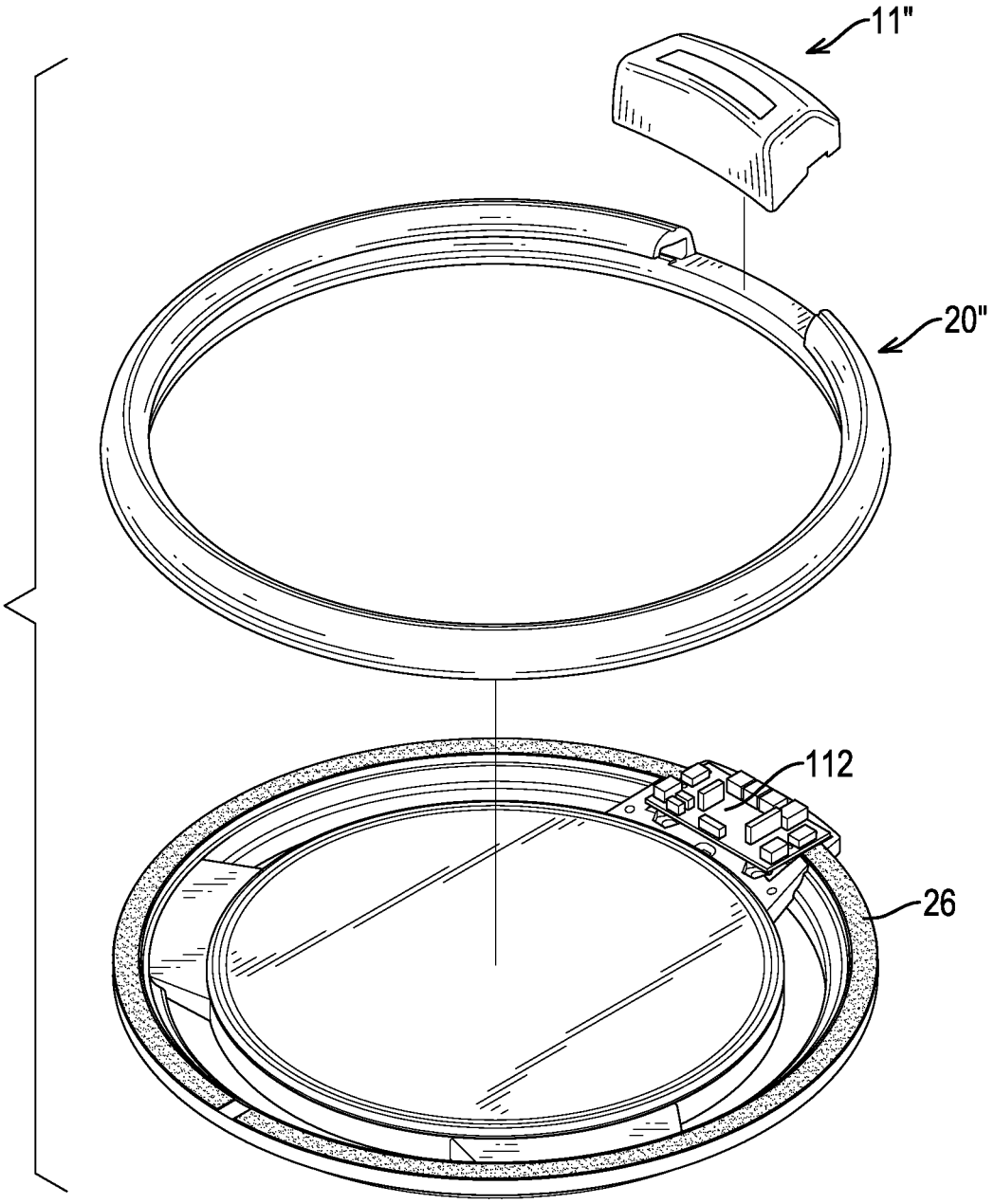
FIG. 8 is an exploded perspective view of a third embodiment of a securing frame of an electronic drum in accordance with the present invention.
Figure 9:
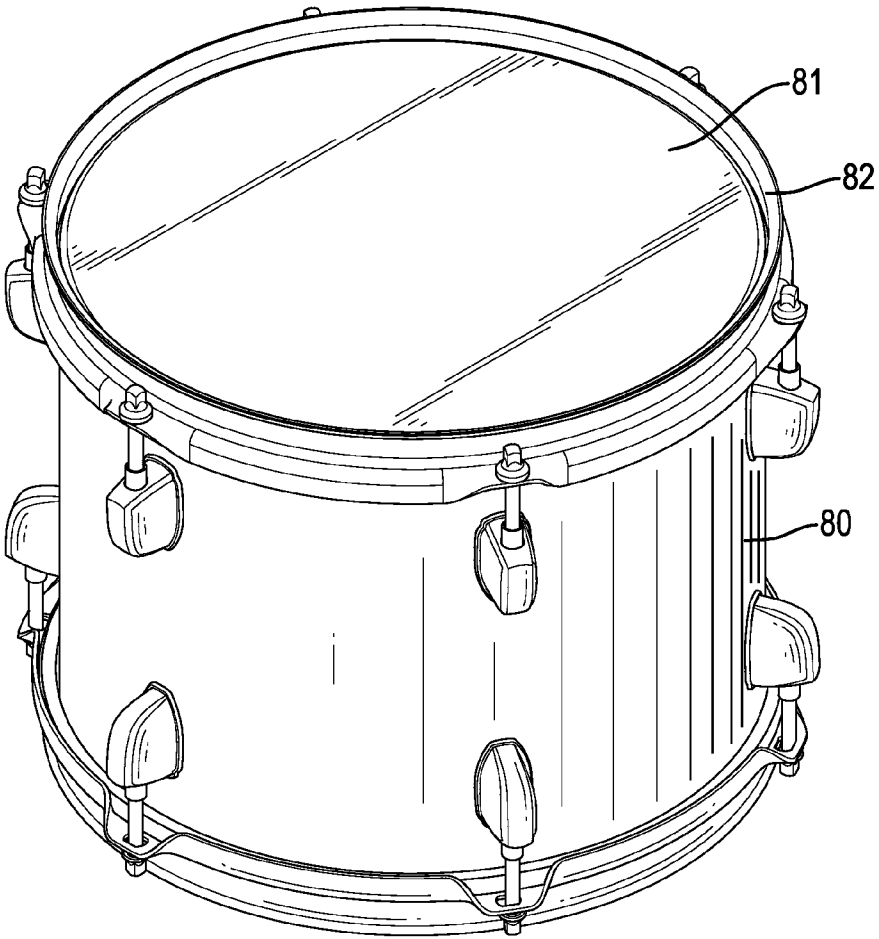
FIG.9 PRIOR ART
FIG. 9 is a perspective view of a conventional drum in accordance with the prior art.
Figure 10:
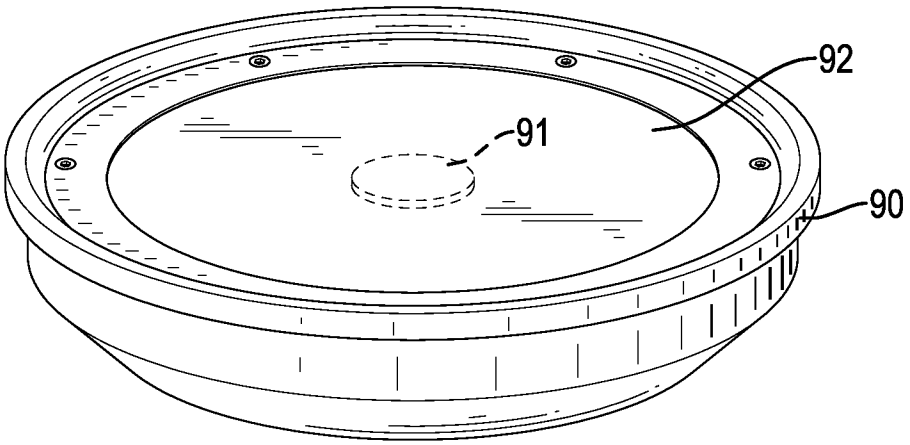
FIG.10 PRIOR ART
FIG. 10 is a perspective view of a conventional electronic drum in accordance with the prior art.

With reference to FIG. 8, the securing frame 20" further has two membrane switches 26 mounted in the securing frame 20" and electrically connected to a circuit board 112 in the connection device 11". Preferably, each membrane switch 26 is curved and is 180° in curvature. With the membrane switches 26, when the securing frame 20" is beaten, the membrane switches 26 can detect the vibrations of the securing frame 20" and sends acoustic signal to the connection device 11" to actuate an outer acoustic device to generate acoustic sound. Accordingly, the user can beat the securing frame 20" to simulate the action of beating on a drum rim, such that the electronic drum in accordance with the present invention is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic drum comprising:

an induction board having:

a drumhead;

a connection device adapted to be electrically connected with an outer acoustic device; and a detecting assembly mounted under the drumhead and electrically connected with the connection device to detect beats on the drumhead and to send acoustic signal to the connection device; and an annular securing frame mounted around the induction board and comprising:

an annular bracket having an outer periphery and a bottom;

an outer securing rib protruding outward from the outer periphery of the annular bracket; and a bottom securing rib protruding from the bottom of the annular bracket, wherein the outer securing rib and the bottom securing rib are configured to respectively abut against top and inner peripheries of a holding rim of a conventional drum such that the induction board is detachably held above a drumhead of the conventional drum.

2. The electronic drum as claimed in claim 1, wherein the securing frame further has an annular elastic collar mounted around the annular bracket and the outer securing rib.

3. The electronic drum as claimed in claim 2, wherein the annular elastic collar has an annular wall formed on and protruding downward from a bottom of the annular elastic collar.

4. The electronic drum as claimed in claim 3, wherein the securing frame further has multiple connecting panels separately formed on and protruding from an inner periphery of the annular bracket and connected to the induction board.

5. The electronic drum as claimed in claim 4, wherein the detecting assembly comprises:

a metal disk mounted under the drumhead and having a bottom opposite to the drumhead; and a sensor chip mounted on the bottom of the metal disk to detect vibrations of the metal disk and electrically connected with the connection device.

6. The electronic drum as claimed in claim 3, wherein the securing frame further has an annular connection plate formed on and protruding from an inner periphery of the annular bracket and connected to the induction board; and the connection plate has multiple ventilation holes formed through the connection plate.

7. The electronic drum as claimed in claim 6, wherein the detecting assembly comprises:

a metal disk mounted under the drumhead and having a bottom opposite to the drumhead; and a sensor chip mounted on the bottom of the metal disk to detect vibrations of the metal disk and electrically connected with the connection device.

8. The electronic drum as claimed in claim 1, wherein the securing frame further has multiple connecting panels separately formed on and protruding from an inner periphery of the annular bracket and connected to the induction board.

9. The electronic drum as claimed in claim 8, wherein the detecting assembly comprises:

a metal disk mounted under the drumhead and having a bottom opposite to the drumhead; and a sensor chip mounted on the bottom of the metal disk to detect vibrations of the metal disk and electrically connected with the connection device.

10. The electronic drum as claimed in claim 1, wherein the securing frame further has an annular connection plate formed on and protruding from an inner periphery of the annular bracket and connected to the induction board; and the connection plate has multiple ventilation holes formed through the connection plate.

11. The electronic drum as claimed in claim 10, wherein the detecting assembly comprises:

a metal disk mounted under the drumhead and having a bottom opposite to the drumhead; and a sensor chip mounted on the bottom of the metal disk to detect vibrations of the metal disk and electrically connected with the connection device.

12. The electronic drum as claimed in claim 1, wherein the detecting assembly comprises:

a metal disk mounted under the drumhead and having a bottom opposite to the drumhead; and a sensor chip mounted on the bottom of the metal disk to detect vibrations of the metal disk and electrically connected with the connection device.

13. The electronic drum as claimed in claim 2, wherein the detecting assembly comprises:

a metal disk mounted under the drumhead and having a bottom opposite to the drumhead; and a sensor chip mounted on the bottom of the metal disk to detect vibrations of the metal disk and electrically connected with the connection device.

14. The electronic drum as claimed in claim 1, wherein the securing frame further has two membrane switches mounted in the securing frame and electrically connected to the connection device.

15. The electronic drum as claimed in claim 14, wherein each membrane switch is curved and is 180° in curvature.

* * * * *